United States Patent [19]

Johnson et al.

[11] 4,040,918

[45] Aug. 9, 1977

[54] METHOD OF ACTIVATING AN ANODE

[75] Inventors: Harlan B. Johnson, Rittman; Aleksandrs Martinsons, Wadsworth; John O. Snodgrass, Akron, all of Ohio

[73] Assignee: PPG Industries, Inc., Pittsburgh, Pa.

[21] Appl. No.: 661,582

[22] Filed: Feb. 26, 1976

[51] Int. Cl.[2] ..... C25B 1/34; C25B 11/08; C25B 11/10

[52] U.S. Cl. ..... 204/98; 204/99; 204/290 F

[58] Field of Search ..... 204/DIG. 10, 35 R, 36, 204/98, 99, 290 F

[56] References Cited

U.S. PATENT DOCUMENTS

| | | | |
|---|---|---|---|
| 3,619,391 | 11/1971 | Eisner | 204/149 |
| 3,632,498 | 1/1972 | Beer | 204/290 F |
| 3,753,889 | 8/1972 | Eisner | 204/198 |

*Primary Examiner*—F.C. Edmundson
*Attorney, Agent, or Firm*—Richard M. Goldman

[57] ABSTRACT

Disclosed is an improved method of conducting electrolysis where a first electrode and a second electrode are inserted in an electrolyte, and an electrical current passes from one of the electrodes to the other electrode. At least one of the electrodes has an oxide coating formed in situ on an electroconductive substrate. According to the disclosed method, an external portion of the coating is abraded to expose an inner portion of the coating.

6 Claims, No Drawings

METHOD OF ACTIVATING AN ANODE

DESCRIPTION OF THE INVENTION

In electrolytic processes, for example, the electrolysis of alkali metal chloride brines, an anode and a cathode are inserted in the electrolyte and an electrical current passes from one of the electrodes to the other electrode, evolving products at the anode and the cathode. In many electrolytic processes at least one of the electrodes has a surface coating of an oxide formed in situ by the thermal oxidation of an oxidizable precursor material. The oxide coating has a thickness of from about 10 to about 1,000 microns and, after some period of time, for example, from several days to several weeks, attains a low overvoltage. For example, in the case of chlor-alkali electrolysis, the anode may be in the form of a metallic substrate having an electrocatalytic metal oxide or mixed metal oxide surface thereon. Frequently, such anodes have a high overvoltage during the first several days to several weeks of operation, for example, a chlorine overvoltage of from about 0.1 volt to about 0.3 volt at 200 amperes per square foot, which drops into the range of from about 0.02 to about 0.05 volt after several days to several weeks.

It has now been found that if an upper portion, i.e., an external portion, of the coating is removed prior to use of the anode, for example, by abrasion or polishing, the high overvoltage break-in period is substantially reduced or even eliminated and economical low overvoltage operation occurs upon start-up of the process.

DETAILED DESCRIPTION OF THE INVENTION

In electrolytic processes where a first anode and a second anode are inserted in an electrolyte and an electrical current is passed from one of the electrodes to the other electrode, evolving product at both the anode and the cathode, both electrodes are characterized by an overvoltage. The overvoltage, which is current dependent, follows the Tafel equation, $$\eta = \alpha i + \beta$$

where $\eta$ = overvoltage
$i$ = current density
$\alpha,\beta$ = constants

In commericial electrolytic processes, at least one of the electrodes, i.e., the anode or the cathode, and frequently both of them, i.e., both the anode and the cathode, may have a surface coating of a metal oxide on a metallic substrate. When such an oxide coating is present, it is frequently formed by the thermal oxidation of a precursor, for example, the thermal decomposition of the precursor to yield the oxide. In this way, a coating is provided having a thickness of from about 10 to about 1,000 microns. The oxide coating functions as an electrocatalyst.

One commerical electrolytic process is the electrolysis of an alkali metal chloride brine such as sodium chloride or potassium chloride, for example, in a chlorate process to yield the alkali metal chlorate, or in a diaphragm cell process to yield chlorine, the alkali metal hydroxide, and hydrogen, or in the mercury cell process to yield chlorine and the alkali metal hydroxide. In the chlor- alkali process, the electrolyte is an alkali metal chloride brine. When the alkali metal chloride is sodium chloride and the process is carried out in a diaphragm cell or a chlorate cell, the electrolyte in contact with the anode is sodium chloride in a concentration of from about 200 to about 300 grams per liter. When the electrolyte is potassium chloride, the concentration of potassium chloride in the electrolyte in contact with the anode is from about 250 to about 380 grams per liter. In the chlor-alkali process, an electrical current is passed from the anode to the cathode evolving product at both the anode and cathode.

The anode is an oxidizing electrode where a non-metal ion forms a non-metal and an electron or a metal forms and ion and an electron. In chlor-alkali electrolysis, the anode reaction is an electron removal from a non-metal ion, i.e., a chloride ion, to form chlorine molecules. The voltage required to accomplish this is greater than the equilbrium voltage by an overvoltage component which is reported to be related to the catalytic effect of the electrode.

The cathode is a reducing electrode where either a non-metal and an electron form to a non-metal ion or a metal ion and an electron form a metal. In chlor-alkali electrolysis the cathode reaction is the evolution of hydrogen and the formation of the correspondng alkali metal hydroxide, such as sodium hydroxide or potassium hydroxide.

Coated electrodes comprise a suitable electroconductive substrate having an electrocatalytic surface thereon. In chlor-alkali processes the surface coating may be present on both the anode and the cathode or only on the anode. The surface on the anode is typically an oxide formed by the thermal oxidation of a precursor material, and more particularly by the thermal decomposition of the precursor in an oxidative atmosphere to yield the oxide. The oxide is generally a mixed oxide of a valve metal and a platinum group metal. The valve metals as used herein are those metals which are also referred to as the film-forming metals. These metals form an oxide upon exposure to acidified materials under anodic conditions. The valve metals are titanium, tantalum, tungsten, hafnium, zirconium, niobium, and vanadium. The platinum group metals are ruthenium, rhodium, palladium, osmium, iridium, and platinum.

The mixed metal oxide coating may be a single oxy compound of a plurality of metals and oxygen, a mixture of two or more oxides, or a solid solution of two or more oxides. One particularly outstanding combination of oxides of a valve metal and a platinum group metal is the titanium dioxide and ruthenium dioxide system where both are predominantly in the rutile form containing from about 20 percent ruthenium dioxide by weight to about 80 percent ruthenium dioxide by weight, balance titanium dioxide and other materials, such as activators, depolarizers, or catalysts. The other materials present may be present in an amount of from about 1 percent or less up to about 20 or 30 or even 50 percent and include oxides of molybdenum, manganese, iron, cobalt, nickel, tin, arsenic, antimony, and bismuth.

The surface coatings which may be treated by the method disclosed herein are those that are formed by the thermal decomposition of a precursor to yield the oxide. The precursors are thermally decomposable compounds of valve metals and the platinum group metals. Suitable precursors include inorganic compounds such as chlorides, bromides, iodides, oxy chlorides, nitrates, sulfates, sulfites, sulfides, and organometallics such as stearates, palmitates, soaps, and resinates of the platinum group metal and the valve metal or film-forming metal.

The oxide coating may be formed by applying one or more coats of a liquid composition containing the precursors to a substrate and heating the coated substrate with the precursor thereon in an oxidative atmosphere to a high enough temperature to form the oxide material. This may be repeated for several coats to give a satisfactory coating on the electrode substrate. In this way, a coating is obtained that is an oxide coating having electrocatalytic properties.

The coating formed thereby has a thickness of from about 10 to about 1,000 microns and a Mohs hardness of from about 6 Mohs to about 8 Mohs. A coating of ruthenium dioxide and titanium dioxide has a chlorine overvoltage of from about 0.10 volt to about 0.30 volt at a current density of 200 amperes per square foot for the first several days to several weeks. After the above described break-in period, the overvoltage then drops to from about 0.02 to about 0.05 volt.

The coating itself is on a metal substrate. Typically, the metal substrate is a film-forming metal, i.e., a valve metal, such as titanium, tantalum, tungsten, hafnium, zirconium, niobium, or vanadium. Alternatively, the substrate material may be silicon metal. Where the substrate is silicon metal, it typically contains sufficient amount of a dopant, for example, nitrogen, phosphorous, arsenic, antimony, bismuth, boron, aluminum, gadolinium, indium, or thalium, to provide a bulk electrical conductivity in excess of 100 (ohm-centimeters)$^{-1}$ and preferably a sufficient amount of said dopant, for example, from about 0.5 to about 1.5 weight percent, to provide a bulk electroconductivity of in excess of 1,000 (ohm-centimeters)$^{-1}$.

The electrode substrate itself may be in the form of sheets, plates, rods, or perforate or foraminous materials. The substrate is microscopically electrolyte impermeable and macroscopically electrolyte permeable. That is, electrolyte can flow between elements of the electrode, for example, between adjacent rods or wire or mesh, but not within the individual elements thereof.

According to the method of this invention, the initial high overvoltage occurring on newly formed electrodes, that is, electrodes not previously in use, may be reduced by removing an upper or external portion of the coating, for example, by abrading, in a suitable abrasive, to reduce the voltage to form about 0.02 to about 0.05 volt at a current density of 200 amperes per square foot.

According to the method of this invention, the external portion of the coating, that is, the upper portion of the coating, for example, an amount sufficient to reduce the overvoltage, is removed from the coated surface of the electrode, i.e., the anode in the case of chlor-alkali electrolysis. The portion of the coating is uniformly removed, for example, by abrasion, such as mechanical abrasion. The amount removed is a fairly small amount, such as would be removed in a polishing operation, for example, by mechanically polishing the electrode coating. In the case of a ruthenium dioxide-titanium dioxide coating on a chlor-alkali cell anode, the amount removed is an amount sufficient to reduce the chlorine overvoltage, i.e., from about 10 angstroms ($10^{-3}$ microns) to about 1,000 angstroms ($10^{-1}$ microns).

While the mechanism of this method is not fully understood, it is believed that either the upper portion of the coating is exposed to the atmosphere during in situ formation of the oxide and a high overvoltage material is formed, or that there is a deficiency in the concentration of the platinum group metal, such as by the formation of a volatile compound in the upper few angstroms of the layer, thereby decreasing the concentration of the oxide of the platinum group metal therein, or that there is an excess of oxygen in the upper portion of the layer, such as by the formation of insulating fully stoichiometric compounds instead of oxygen deficient semi-conducting compounds, in the portion of the coating exposed to the atmosphere during the formation of the coating. However, when the external portion of the surface coating is removed a lower overvoltage portion is exposed.

According to the method of this invention, a fine, hard abrasive is used to remove a uniform fraction of the external portion, i.e., the upper portion of the coating. Typically, the abrasive material has the Mohs hardness of from about 8 Mohs to about 10 Mohs. Typical 8 Mohs hardness materials are topaz and quartz, while corundum and sapphire are typical 9 Mohs materials, and diamond is a typical 10 Mohs material. It has been found that particularly satisfactory results are obtained with materials having a Mohs hardness of about 9. Materials having a Mohs hardness of less than about 8 do not rapidly remove the surface, while materials having a Mohs hardness of 10 or greater, while functioning satisfactorily, are handicapped by high cost. One particular outstanding material is corundum, a massive crystalline aluminum oxide.

The abrasive itself is typically in a size of from about U. S. standard sieve size 70 to about U.S. standard sieve size 600. Materials that are coarser than U.S. standard sieve size 70, while useful in the method of this invention, remove more of the coating than is necessary for the practice of this invention. Materials that are finer than U.S. standard sieve size 600, while removing a portion of the surface material, require a large number of passes of the abrasive over the surface of the electrode in order to provide satisfactory removal. The size of abrasive contemplated herein may be those characterized in the trade as "fine", i.e., from about 70 to about 280 U.S. standard sieve size, as "very fine", i.e., from about 280 to about 600 U.S. standard sieve size, and as "optical flour", i.e., having a U.S. standard sieve size finer than 600.

According to one exemplification of this invention, abrading may be commenced with "fine" abrasive and subsequently thereafter with "very fine" abrasive. Alternatively, "fine" abrasive alone may be used, or "very fine" abrasive alone may be used. Materials in a size range of from about U.S. standard sieve size 70 to about U.S. standard sieve size 600 may be used. Preferably materials having a size of from about U.S. standard sieve size 120 to about U.S. standard sieve size 480 are used.

According to one preferred exemplification of the method of this invention, the abrasive is slurried in water to provide a smooth, nonlumpy consistency as is well known in the polishing art. This slurry may be provided by having from about one part abrasive by weight per one part water by weight up to about one part abrasive by weight per 10 parts water by weight. Preferably, the concentration of abrasives is from about one part abrasive by weight per two parts water by weight up to about one part abrasive by weight per five parts water by weight. Particularly good results have been obtained according to the method of this invention where the abrasive content is from about one part abrasive per two parts water by weight to one part abrasive per four parts water by weight.

According to the preferred exemplification of this invention, the slurry contacts the face of the electrode using standard abrasive polishing techniques, for example, turning the anode face down in a pool of the slurried abrasive and having 100 complete strokes of the electrode, i.e., 200 passes of the electrode, through the abrasive. Alternatively, belt polishing may be used, for example, with a wet belt or wheel polishing, preferably with a wet wheel.

According to the method of this invention, there is thereby provided a method of abrading an external portion of the coating of the anode to reduce the initial overvoltage of the anode. It is also within the contemplated scope of this invention to abrade the upper surface of an electrode that has undergone substantial periods of electrolysis whereby the overvoltage of the electrode has begun to climb.

While the method of this invention has been described with certain exemplifications and embodiments, for example, coated titanium and silicon anodes used in chlor-alkali electrolysis, it is to be understood that the method of this invention may also be used in other exemplifications and embodiments, for example, in the abrading of coated cathodes, such as metal oxide coated steel cathodes.

The following examples are illustrative.

EXAMPLE 1

An unused Electrode Corporation titanium electrode having a ruthenium dioxide-titanium dioxide coating was tested before and after abrasion.

Before abrasion, the anode had a chlorine overvoltage of 0.20 volt at 200 amperes per square foot and 0.24 volt at 500 amperes per square foot. The surface was then abraded on a Gardener Abrasion Machine using 25 grams of American Optical Co. abrasive "303½" corundum with 75 grams of water.

The slurry was placed in the Gardener Abrasion Machine and the electrode was given 100 strokes, i.e., 200 passes, through the slurry. Thereafter, the electrode was removed from the slurry, rinsed with water, and the overvoltage thereof tested. The chlorine overvoltage was 0.09 volt at 200 amperes per square foot and 0.13 volt at 500 amperes per square foot.

EXAMPLE 2

Three electrodes were tested to determine the effect of abrasion on the chlorine overvoltage. Each electrode had a silicon substrate containing approximately 0.5 weight percent boron, balance silicon. The electrodes were prepared by coating the silicon with a ruthenium chloridetitanium chloride mix and heating to form an oxide coating.

Prior to coating, each of the electrodes was sandblasted, cleaned with Comet, rinsed and etched for 10 minutes in 2½ normal sodium hydroxide at 94° C., rinsed in water, and dried with acetone.

A titanium chloride composition was prepared by 100 grams of 98 weight percent Alfa Products $TiCl_3$ with 392 grams of 15 weight percent HCl. A ruthenium trichloride composition was prepared by adding 100 grams of $RuCl_3$ hydrate to 400 grams of absolute ethanol.

The first electrode, hereinafter identified as electrode I, was coated with a composition prepared from 1.85 grams of the $TiCl_3$ solution, 0.15 gram of a 50 weight percent hydrogen peroxide solution, and 3.0 grams of the $RuCl_3$ solution. The second electrode, hereinafter identified as electrode II, was coated with a composition prepared from 3.70 grams of the $TiCl_3$ solution, 0.25 gram of a 50 weight percent hydrogen peroxide solution, and 3.0 grams of the $RuCl_3$ solution. The third electrode, hereinafter identified as electrode III, was coated with a composition prepared from 0.9 gram of the $TiCl_3$ solution, 0.06 gram of the 50 weight percent hydrogen peroxide solution, 0.75 gram of the $RuCl_3$ solution, and 0.9 gram of a 48 percent $H_2F_2$ solution.

The first coat was applied to each of the electrodes and the electrodes were then placed in an oven at 200° C. for 1 hour, increased to 400° C. over 8 minutes, and kept at 400° C. for 10 minutes. Thereafter, a second coat was applied to each electrode, and each electrode was heated to 400° C. for 10 minutes. Finally, a third coat was applied to each electrode, the electrode was heated to 400° C. for 10 minutes, then heated from 400° C. to 550° C. for five minutes, and thereafter maintained at 550° C. for 20 minutes.

The electrodes were then tested for chlorine overvoltage, abraded as described in Example 1 with 200 passes through a 25 weight percent slurry of American Optical Company Abrasive "303½" corundum on a Gardener Abrasion Machine, rinsed with water, and re-testted.

Electrode I had an overvoltage of 0.19 volt at 200 amperes per square foot before abrasion and from 0.05 to 0.09 volt after abrasion. Electrode II had an overvoltge of 0.49 volt before abrasion and from 0.06 to 0.08 volt after abrasion. Electrode III had a chlorine overvoltage of 0.39 volt before abrasion and from 0.06 to 0.07 volt after abrasion.

While the above tests are representative tests and other electrodes started out with higher and lower initial voltages, depending on various factors such as the coating composition and heat treatment, a reduction in overvoltage was observed in all cases after abrasion.

While the above invention has been described with reference to certain preferred exemplifications and embodiments thereof, the invention is not to be so limited except as in the claims appended hereto.

We claim:

1. In a method of electrolyzing an alkali metal chloride brine comprising passing an electrical current from an anode through said brine to a cathode, evolving chlorine at an overvoltage on said anode, said anode having a surface coating comprising an oxide of a film-forming metal and an oxide of a platinum group metal on a metal substrate, said surface coating formed by applying compounds of said film-forming metal and said platinum group metal to the substrate and heating said substrate to form a coating of the oxides, the improvement comprising abrading an external portion of said oxide coating whereby to reduce the initial overvoltage of said anode.

2. The method of claim 1 comprising abrading the oxide coating with an abrasive having a Mohs hardness greater than 8.

3. The method of claim 1 comprising abrading the oxide coating with an abrasive having a particle size of from about U.S. standard sieve size 70 to about U.S. standard sieve size 600.

4. In a method of electrolyzing an alkali metal chloride brine comprising passing an electrical current from an anode through said brine to a cathode, evolving chlorine at an overvoltage on said anode, said anode having a surface coating comprising an oxide of a film-forming metal and an oxide of a platinum group metal on a metal substrate, said surface coating formed by applying thermally decomposable compounds of said film-forming metal and said platinum group metal to the substrate and heating said substrate to thermally form a coating of the oxides, the improvement comprising abrading an external portion of said oxide coating whereby to reduce the initial overvoltage of said anode.

5. The method of claim 4, comprising abrading the oxide coating with an abrasive having a Mohs hardness greater than 8.

6. The method of claim 4 comprising abrading the oxide coating with an abrasive having a particle size of from about U.S. standard sieve size 70 to about U.S. standard sieve size 600.

* * * * *